US011606857B2

(12) United States Patent
Vassal et al.

(10) Patent No.: US 11,606,857 B2
(45) Date of Patent: Mar. 14, 2023

(54) METHOD FOR DETERMINING A QUALITY FACTOR OF AN ACCELERATING CAVITY OF A PARTICLE ACCELERATOR

(71) Applicants: COMMISSARIAT A L'ENERGIE ATOMIQUE ET AUX ENERGIES ALTERNATIVES, Paris (FR); CENTRE NATIONAL DE LA RECHERCHE SCIENTIFIQUE, Paris (FR); UNIVERSITE DE CAEN NORMANDIE, Caen (FR)

(72) Inventors: Adrien Vassal, Grenoble (FR); Patrick Bonnay, Grenoble (FR); François Bonne, Grenoble (FR); Adnan Ghribi, Caen (FR)

(73) Assignees: COMMISSARIAT A L'ENERGIE ATOMIQUE ET AUX ENERGIES ALTERNATIVES, Paris (FR); CENTRE NATIONAL DE LA RECHERCHE SCIENTIFIQUE, Paris (FR); UNIVERSITE DE CAEN NORMANDIE, Caen (FR)

( * ) Notice: Subject to any disclaimer, the term of this patent is extended or adjusted under 35 U.S.C. 154(b) by 323 days.

(21) Appl. No.: 16/662,327

(22) Filed: Oct. 24, 2019

(65) Prior Publication Data

US 2020/0137869 A1 Apr. 30, 2020

(30) Foreign Application Priority Data

Oct. 24, 2018 (FR) ..... 1859806

(51) Int. Cl.
*H05H 7/22* (2006.01)
*H05H 7/02* (2006.01)

(52) U.S. Cl.
CPC ..... *H05H 7/22* (2013.01); *H05H 2007/025* (2013.01); *H05H 2007/225* (2013.01); *H05H 2007/227* (2013.01)

(58) Field of Classification Search
CPC ..... H05H 7/22; H05H 2007/025; H05H 2007/225; H05H 2007/227; H05H 9/00
See application file for complete search history.

(56) References Cited

U.S. PATENT DOCUMENTS

2013/0139525 A1 6/2013 Alamir et al.
2016/0309573 A1 * 10/2016 Kephart ..... H05H 7/20

FOREIGN PATENT DOCUMENTS

GB 2553804 A * 3/2018 ..... F01P 9/00
WO 2012/011017 A1 1/2012

OTHER PUBLICATIONS

Nakai et al., "Cryogenics for the KEKB superconducting crab cavities", Japan, Jun. 2010, pp. 3834-3836.*

(Continued)

*Primary Examiner* — Jimmy T Vu
(74) *Attorney, Agent, or Firm* — WHDA, LLP

(57) ABSTRACT

The method for determining a quality factor of an accelerating superconducting cavity of a particle accelerator, in particular a linear particle accelerator, the method includes determining a heat load to which a cryomodule having the accelerating cavity and a bath of cryogenic fluid is subjected, then determining a quality factor based on the determination of the heat load during the operation of the particle accelerator.

19 Claims, 14 Drawing Sheets

(56) References Cited

OTHER PUBLICATIONS

Nakai et al., "Cryogenics for the KEKB Superconducting Crab Cavities", Proceedings of IPAC 2010, Kyoto, Japan, Jun. 2010, pp. 3834-3836; cited in the French Search Report.
Goryashko et al., "High-Precision Measurements of the Quality Factor of Superconducting Cavities at the FREIA Laboratory", Proceedings of SRF 2015, Whistler, BC, Canada, Dec. 2015, pp. 810-813; cited in the French Search Report.
Xu et al., "Improvement of the Q Factor Measurement in RF Cavities", Proceedings of IPAC 2013, Shanghai, China, 2013, pp. 2489-2491; cited in the Specification.
Xu et al., "Improvement of the Q-factor measurement in RF cavities", Brookhaven National Laboratory, Upton, NY, Nov. 2012, 12 pages; corresponds to Xu et al., Proceedings of IPAC 2013 cited in the Specification.
French Search Report and Written Opinion dated Oct. 14, 2019 issued in counterpart application No. FR1859806; w/ English machine translation (24 pages).

* cited by examiner

METHOD FOR DETERMINING A QUALITY FACTOR OF AN ACCELERATING CAVITY OF A PARTICLE ACCELERATOR

TECHNICAL FIELD OF THE INVENTION

The invention relates to a method for determining a quality factor of an accelerating cavity of a particle accelerator, in particular a linear particle accelerator. The invention also relates to a method for operating a particle accelerator. The invention furthermore relates to a device for determining a quality factor and to a particle accelerator comprising such a device.

PRIOR ART

Within particle accelerators, in particular linear particle accelerators, superconducting accelerating cavities (referred to as RF cavities) perform the acceleration of particles. These cavities are manufactured from a very low temperature superconductor such as niobium, and are submerged in a volume of cryogenic fluid, such as in particular helium. The performance of an accelerating cavity, and in particular the maximum power able to be accepted by the cavity, depends on its quality factor. This factor is directly related to the surface state and to the geometry of the cavity. Under certain conditions, the cavity may lose its superconducting state, this triggering an effect known as quench that leads to a complete stoppage of the beam in the particle accelerator. Degradation of the quality factor also degrades the accelerating capacity of the cavity in question.

Currently, quality factor is measured using a probe that measures an electromagnetic field in the cavity. This measurement is carried out when the accelerator is off-line, generally before the start-up of the installation or during maintenance periods. In particular, the document "Improvement of the Q-factor measurement in RF cavities" by Wencan Xu, S. Belomestnykh, and H. Hahn (BNL Technical Note, BNL-98894-(Ipac 13): 2489-2491, 2013) describes such a method. However, it is impossible to use this measuring method when the particle accelerator is in use.

SUBJECT OF THE INVENTION

The aim of the invention is to provide a method for determining a quality factor of an accelerating cavity of a particle accelerator that remedies the aforementioned drawbacks and that improves the devices and methods known from the prior art. In particular, the invention allows continuous measurement of quality factor. The obtained measurement has the advantage of being able to be carried out when the accelerator is in use. Moreover, the determination of the quality factor according to the invention may allow deterioration of the cavity to be detected.

The invention relates to a method for determining a quality factor of an accelerating superconducting cavity of a particle accelerator, in particular a linear particle accelerator, the method comprising the following steps:

- determining a heat load to which a cryomodule comprising the accelerating cavity and a bath of cryogenic fluid is subjected, then
- determining a quality factor based on the determination of the heat load during the operation of the particle accelerator.

The steps of determining the heat load and of determining the quality factor may be carried out simultaneously and in real time.

The step of determining the heat load may comprise the use of a state observer.

The state observer may comprise an estimation of a mass flow rate of cryogenic fluid passing through a valve of the cryomodule taking the form $$\dot{m}=\beta_T\cdot\dot{m}_{comp}+(1-\beta_T)\cdot\dot{m}_{incomp}$$

in which:

$\dot{m}_{comp}$ is a mass flow rate of cryogenic fluid in compressible form through the valve, $\dot{m}_{incomp}$ is the mass flow rate of cryogenic fluid in incompressible form through the valve, and $\beta_T$ is a coefficient of isothermal compressibility of the cryogenic fluid.

The state observer may comprise an estimation of a density and of a specific internal energy of the bath of cryogenic fluid.

Said estimation may be carried out based on:

- a volume of cryogenic fluid in the liquid state, which is calculated based on a measurement of a height of the cryogenic fluid in the liquid state and/or calculated based on a measurement of the amount of cryogenic fluid entering and exiting the bath of cryogenic fluid; and
- a static heat load and a dynamic heat load received by the bath of cryogenic fluid; and
- an input specific enthalpy and an output specific enthalpy of the cryogenic bath, based on a measurement of the pressure of the bath of cryogenic fluid, or
- an output temperature of the bath of cryogenic fluid, based on a measurement of the pressure of the bath of cryogenic fluid and on the input mass concentration of the bath of cryogenic fluid.

The invention also relates to a method for operating a particle accelerator, in particular a linear particle accelerator, comprising at least one accelerating cavity, the operating method comprising implementing the method for determining a quality factor of at least one accelerating cavity such as defined above and a step of modifying at least one operating parameter of said accelerating cavity depending on its quality factor.

Said operating parameter may be a power setpoint value for a radiofrequency wave emitted in the accelerating cavity, and the modifying step may comprise decreasing the value of the power setpoint if the quality factor of at least one accelerating cavity crosses a preset threshold, the other cavities of the particle accelerator, when they exist, being able to continue to operate.

The invention also relates to a device for determining a quality factor of at least one accelerating cavity of a particle accelerator, the determining device comprising hardware and/or software elements that implement the method such as defined above, in particular hardware and/or software elements designed to implement the method such as defined above.

The invention also relates to a particle accelerator, in particular a linear particle accelerator, comprising at least one determining device such as defined above.

The particle accelerator may comprise at least one cryomodule comprising an accelerating cavity or a plurality of accelerating cavities and a bath of a cryogenic fluid.

The invention also relates to a computer program product, comprising program-code instructions stored on a computer-readable medium, for implementing the steps of the method such as defined above, when said program runs on a computer, or a computer program product that is downloadable from a communication network and/or stored on a computer-readable and/or computer-executable data medium, comprising instructions that, when the program is executed by a computer, lead the latter to implement the method such as defined above.

The invention also relates to a data storage medium that is readable by a computer, on which is stored a computer program comprising program-code instructions for implementing the method such as defined above, or computer-readable storage medium comprising instructions that, when they are executed by a computer, lead the latter to implement the method such as defined above.

DESCRIPTION OF ONE EMBODIMENT

Description of the Device

Figure 1:
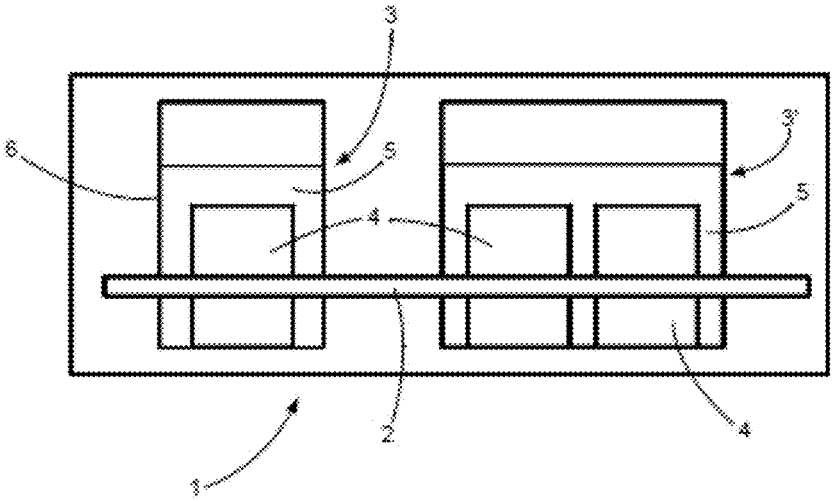
FIG. 1 is a schematic view of a particle accelerator according to one embodiment of the invention.

FIG. 1 schematically illustrates a linear particle accelerator 1 comprising a longitudinal tube 2 able to convey particles, and two cryomodules 3, 3' arranged in series along the longitudinal tube 2. The particle accelerator 1 could comprise even more cryomodules. Each cryomodule 3, 3' comprises at least an accelerating cavity 4 and a bath of cryogenic fluid 5. The bath of cryogenic fluid 5 is contained in an enclosure 6 that envelopes the accelerating cavity 4. The role of the bath of cryogenic fluid 5, which is kept at a temperature of about 4 K, is to keep the temperature of the cavity below its critical temperature, and in particular below 9.2 K. As may be seen in FIG. 1, a first type of cryomodule 3 comprises a single accelerating cavity 4 and a second type of cryomodule 3' comprises two accelerating cavities 4. As a variant, other types of cryomodules could comprise any number of cavities and a particle accelerator could comprise any arrangement of cryomodules. The cryomodule may be equipped with a peripheral cooling system (not shown, this type of cooling system being called a thermal shield) allowing its external jacket to be kept at a given temperature, for example at a temperature of 70 K.

Figure 2:
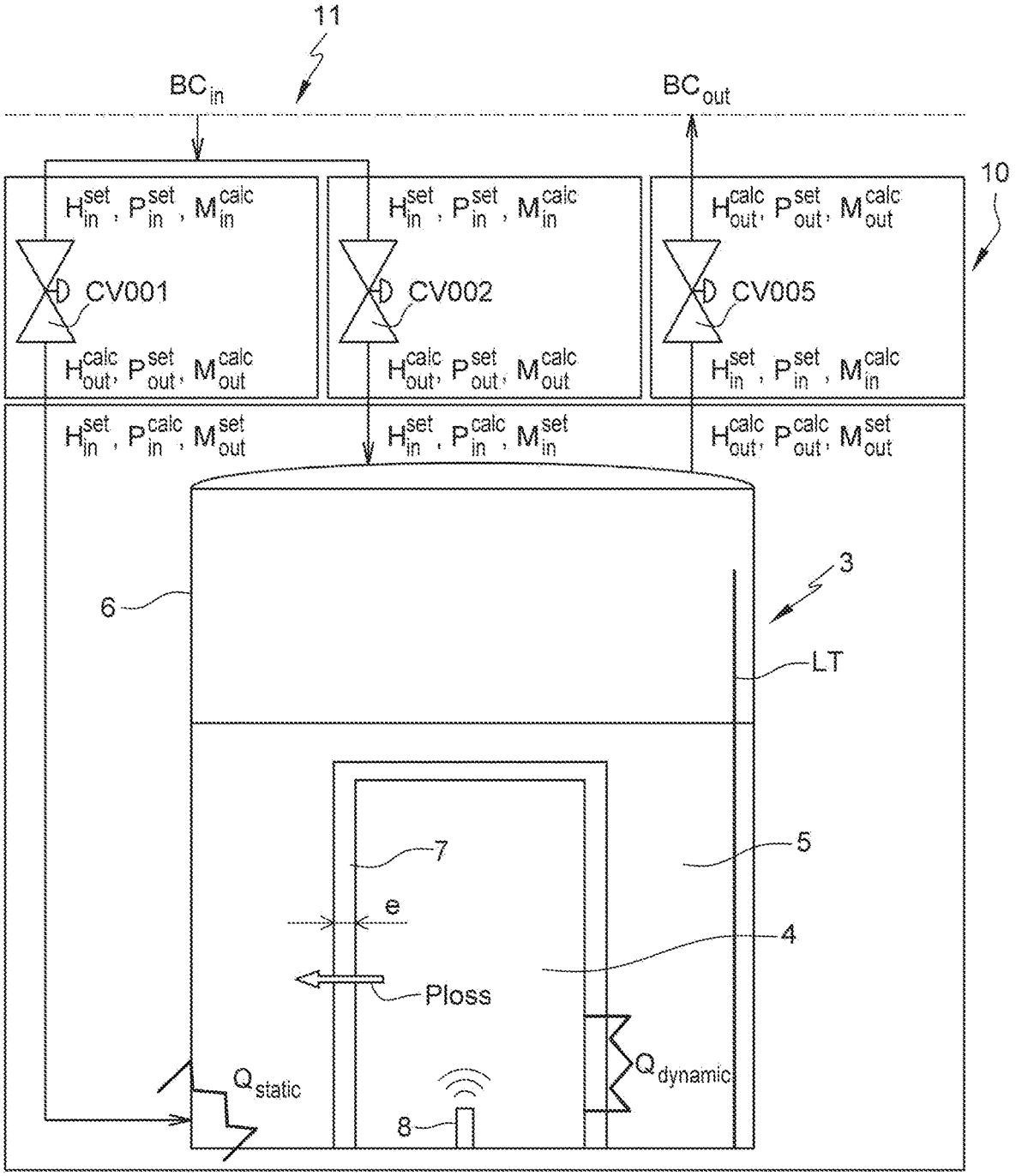
FIG. 2 is a schematic view of a cryogenic system equipped with a cryomodule.

With reference to FIG. 2, the design of a cryomodule 3 equipped with a single cavity 4 will now be described in more detail. An accelerating cavity 4 comprises walls 7 that are for example made of niobium, of an alloy of niobium and titanium, or even of any other material suitable for manufacturing the walls of superconducting accelerating cavities. The walls 7 have a given thickness e. Niobium is a superconductor when it is kept at a temperature below 9.2 K. The cavity 4 also comprises a radiofrequency antenna 8 that is able to emit electromagnetic waves in order to accelerate particles passing through the cavity 4. The interior of the cavity 4 is under a perfect or almost, perfect vacuum. The cryogenic fluid 5 in which the cavity 4 is submerged is advantageously boiling helium present partially in the liquid state and partially in the gaseous state. Even so, it is possible to envision using other chemical compositions for the cryogenic fluid 5.

The helium in the liquid state is denser than the helium in the gaseous state. Under the effect of gravity, the helium in the liquid state therefore occupies a lower volume of the enclosure 6 of the cryomodule 3 whereas the helium in the gaseous state occupies a higher volume of the enclosure. The helium bath therefore behaves as a phase separator, i.e. a bath in which the equilibrium reached between the gaseous state and the liquid state of the same fluid is dependent on the pressure and temperature conditions. In the rest of the document, the expression "phase separator" will therefore also be used to refer to the helium bath contained in the cryomodule 3. The cryomodule is equipped with a level sensor LT, which is able to measure the height of helium in liquid form within the enclosure of the cryomodule.

The phase separator is subjected to a heat load that may be decomposed into two parts. On the one hand the phase separator is subjected to a measurable static heat load $Q_{static}$, due to heat exchange by conduction, convection and radiation between the external environment of the cryomodule at room temperature (i.e. about 300 K) and the cryogenic fluid at a temperature of 4 K. On the other hand, the phase separator is subjected to a dynamic heat load $Q_{dynam}$ due to the power of the electromagnetic field in the cavity and/or to the passage of particles through the cavity. This dynamic load will be determined (in other words estimated, simulated or calculated) according to the description given below. From a thermodynamic point of view, the cavity 4 has no other effect than delivering additional heat to the helium bath.

The heat load may reflect the radiofrequency power injected into the cavity but not solely. It may reflect a degradation in the isolation vacuum, low-energy electron emission from a radiofrequency coupler or in the cavity, field emission or on-line loss of the beam.

The thermodynamic model of a cryomodule 3' equipped with two accelerating cavities 4 is equivalent to the thermodynamic model of a cryomodule 3 equipped with a single accelerating cavity 4. Only three parameters of these models differ the volume of the enclosure Vol containing the cryogenic fluid and the static heat load $Q_{static}$ and dynamic heat load $Q_{dynam}$ acting on the cryogenic fluid 5. The invention will be described in detail through the example of a cryomodule equipped with a single accelerating cavity. Those skilled in the art will be able to transpose these teachings to a cryomodule comprising two or more accelerating cavities.

A cryogenic system 10 comprises the cryomodule 3 and three valves CV001, CV002, CV005, allowing the cryomodule 3 to be connected to a circuit 11 for distributing helium. A first valve CV001 is a helium inlet valve and is connected to a lower portion of the helium bath, at a point where the helium is in liquid form (once the temperature of the helium has been decreased to its operating temperature). A second valve CV002 is also a helium inlet valve and is connected to an upper portion of the helium bath, at a point where the helium is in gaseous form. A third valve CV005 is a helium outlet valve and is connected to the upper portion of the helium bath, at a point where the helium is in gaseous form. The first valve CV001 may be used to fill the enclosure of the cryomodule with helium. The cryogenic system 10 need not comprise this first valve CV001 if the enclosure is fillable with helium in some other way. The first valve CV001 is not used for regulating purposes. The second valve CV002 may be used to regulate the helium level in the enclosure of the cryomodule. The third valve CV005 may be used to regulate the pressure in the enclosure of the cryomodule. The first and second valves CV001, CV002, which are referred to as supply valves, are connected to a line that supplies two-phase helium. The third valve CV005, which is referred to as the exhaust valve, is connected to a return line. These lines are not shown in FIG. 2 but have been replaced by the input boundary conditions $BC_{in}$ and the output boundary conditions $BC_{out}$. The input boundary conditions $BC_{in}$ are given by the pressure $P_{in}$ and the enthalpy $H_{in}$ at the inlet of the supply valves CV001 and CV002. The output boundary conditions $BC_{out}$ are given by the pressure $P_{out}$ at the outlet of the exhaust valve CV005. The degree of openness of each valve may be adjusted in order to make the flow rate of helium through it gradually vary. The position of each of these valves, i.e. its percentage degree of openness, may be recorded manually or automatically.

A triplet of variables is associated with each input or output of the assembly of components: the internal pressure P (expressed in bars absolute), the specific enthalpy H (expressed in J/kg) and the mass flow rate $\dot{m}$ (expressed in kg/s) represented by the letter "M" in FIG. 2. The physical properties of the helium are thus defined locally. These variables are the data exchanged between the various elements of the model. The index associated with each of the variables indicates whether it is a question of an input ("in") or an output ("out") of the model. The exponent defines whether the variable is calculated ("calc") or indeed set by a neighbouring component ("set").

Figure 3:
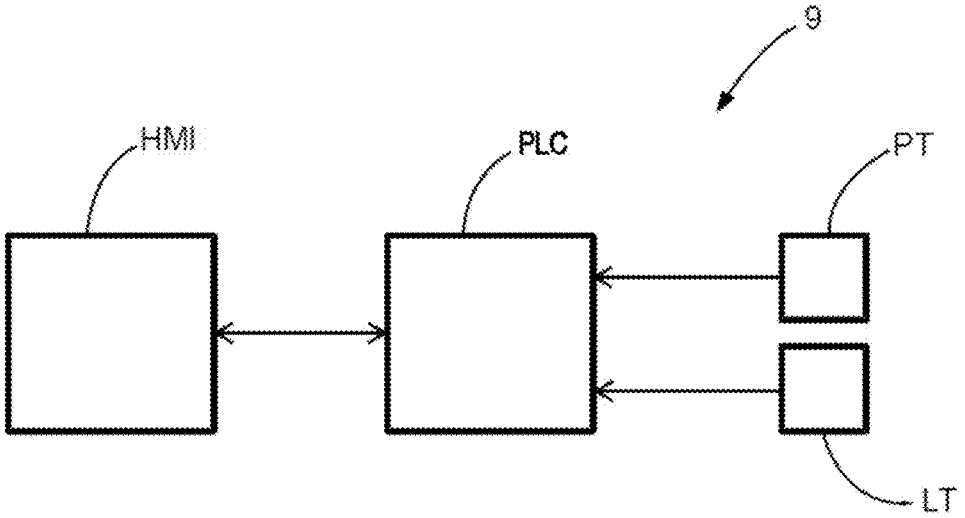
FIG. 3 is a schematic view of a connection between a human-machine interface, a programmable logic controller and sensors of the cryogenic system.

The cryogenic system also comprises a helium-pressure sensor PT (illustrated in FIGS. 4A to 4D). This sensor may for example be positioned upstream of the third valve CV005, i.e. between the third valve and the helium bath. The pressure sensor PT and the level sensor LT are able to continuously take measurements of the pressure and level of the liquid helium, i.e. they deliver a signal that fluctuates depending on the variation in the pressure in the helium bath and in the height of liquid helium. With reference to FIG. 3, they are connected to a programmable logic controller PLC. This logic controller may advantageously itself be connected to a human-machine interface HMI, such as a desktop computer or any other display means intended for use by a user. If the logic controller implements the determining method according to the invention, the human-machine interface HMI merely serves to display the result. The pressure sensor PT and the level sensor LT, the programmable logic controller PLC and the human-machine interface HMI (when there is one) all form part of a device 9 for determining quality factor $Q_0$.

There are two ways of implementing the method for estimating quality factor: either the calculations are carried out by the programmable logic controller PLC and the result is communicated to the human-machine interface HMI, or the logic controller transmits the data from the sensors PT, LT to the human-machine interface HMI and the latter performs the calculations. The programmable logic controller PLC and the human-machine interface HMI are computers and comprise means for implementing the method for estimating quality factor, and in particular a memory and a processing unit. The first option is recommended since it makes it possible to avoid potential bugs in the human-machine interface (programmable logic controllers being designed to minimize the risk of bugs). In the rest of the description, it will therefore be assumed that the method is implemented by the programmable logic controller PLC.

The various valves and sensors of the cryogenic system are connected to one or more controllers CTRL that are able to regulate the helium pressure and the liquid-helium level inside the cryomodule by controlling the valves CV002 and CV005. With reference to FIGS. 4A, 4B, 4C and 4D, four possible control structures will now be described.

Figure 4A:
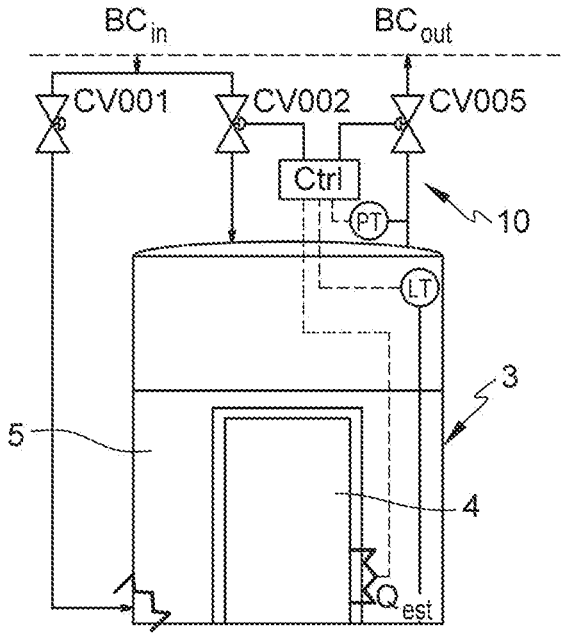
FIGS. 4A, 4B, 4C and 4D are schematic views of various alternative configurations of a cryogenic system.

FIG. 4A illustrates a centralized control structure: a single controller CTRL is able to control both valves CV002 and CV005.

Figure 4B:
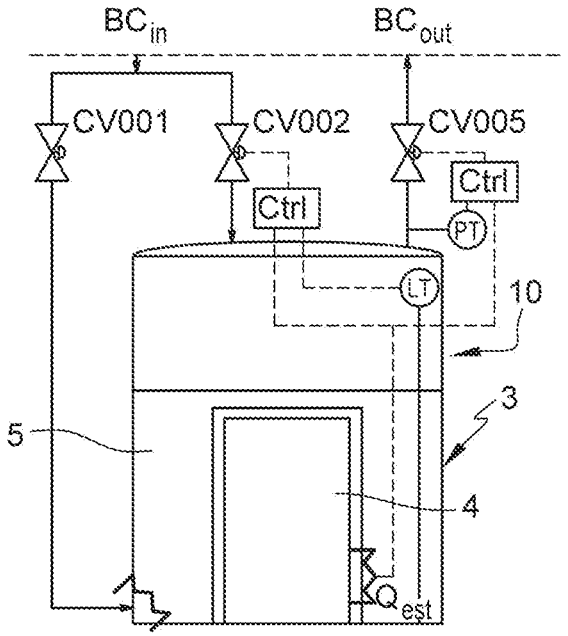

FIG. 4B illustrates a decentralized structure for controlling the degree of openness of the second valve CV002 and of the third valve CV002: this control structure uses two separate controllers CTRL and completely decouples the regulation of level and pressure.

Figure 4C:
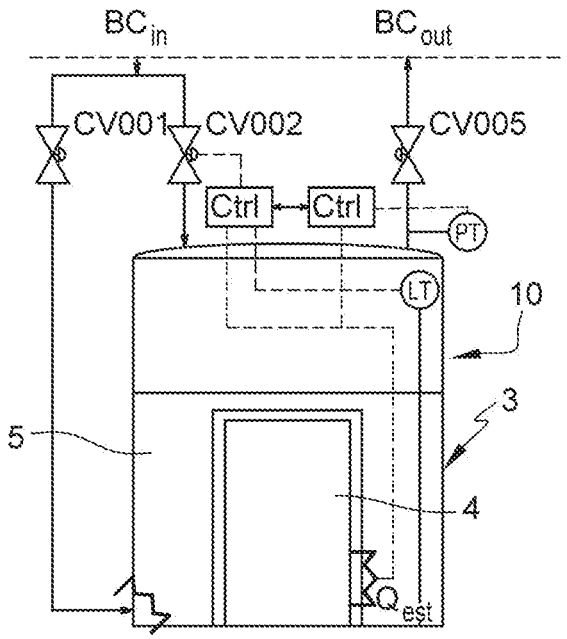

FIG. 4C illustrates a distributed control structure: it is based on the same operating principle as the decentralized control structure but with interaction between the two controllers CTRL of pressure and level.

Figure 4D:
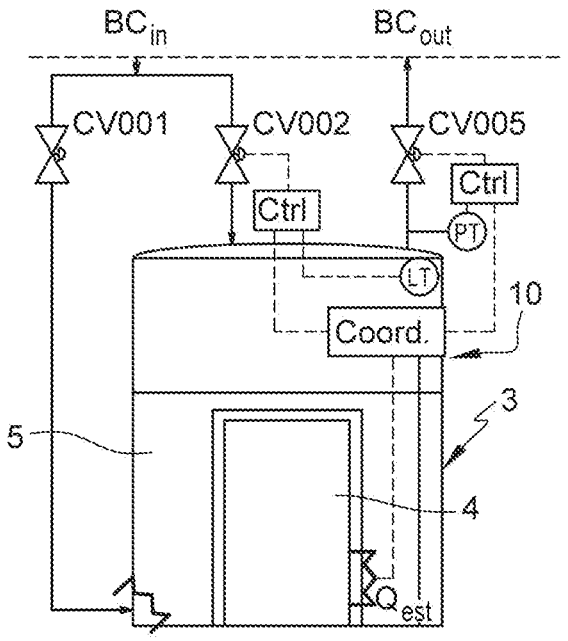

FIG. 4D illustrates a hierarchized control structure: a coordinator Coord controls two separate controllers CTRL and ensures the stability of the cryogenic system.

The control structures CTRL and Coord use the estimation of the heat load on the helium bath to improve the overall stability of the system, as will be described in detail below.

Figure 5:
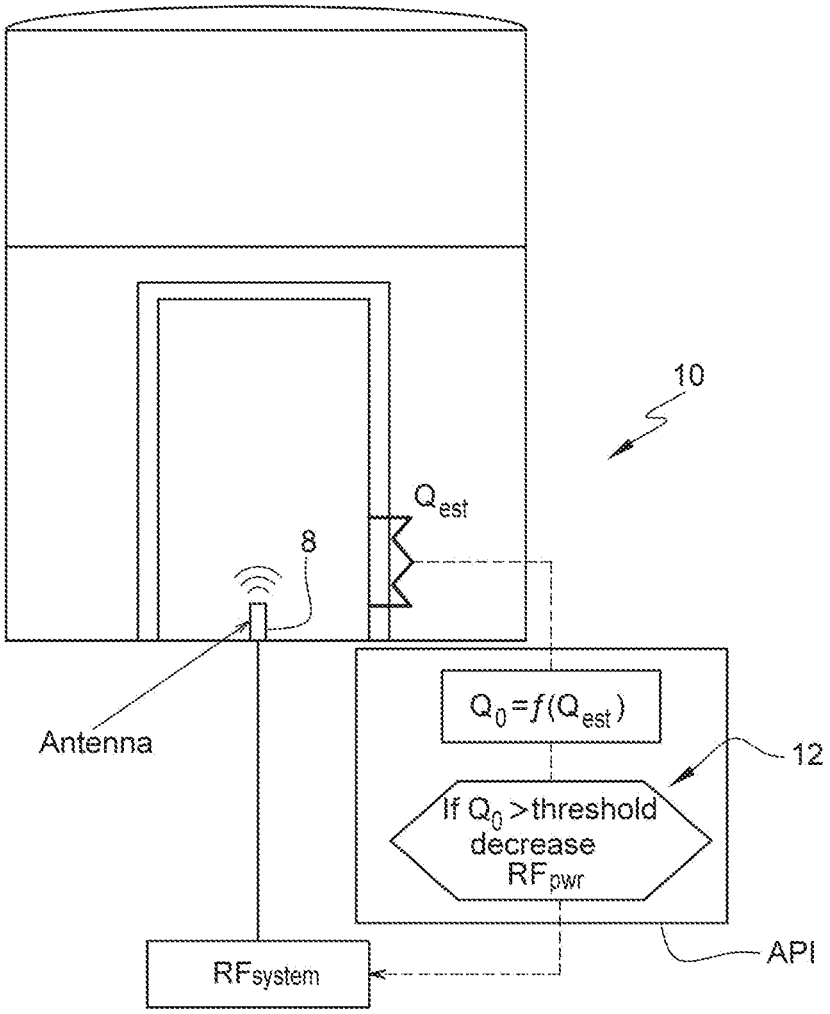
FIG. 5 is a schematic view of a cryogenic system equipped with a regulating means.

FIG. 5 illustrates a cryogenic system 10 equipped with a means 12 for regulating the power emitted by the radiofrequency antenna depending on the estimation of the quality factor Q0.

DESCRIPTION OF THE METHOD

Figure 6:
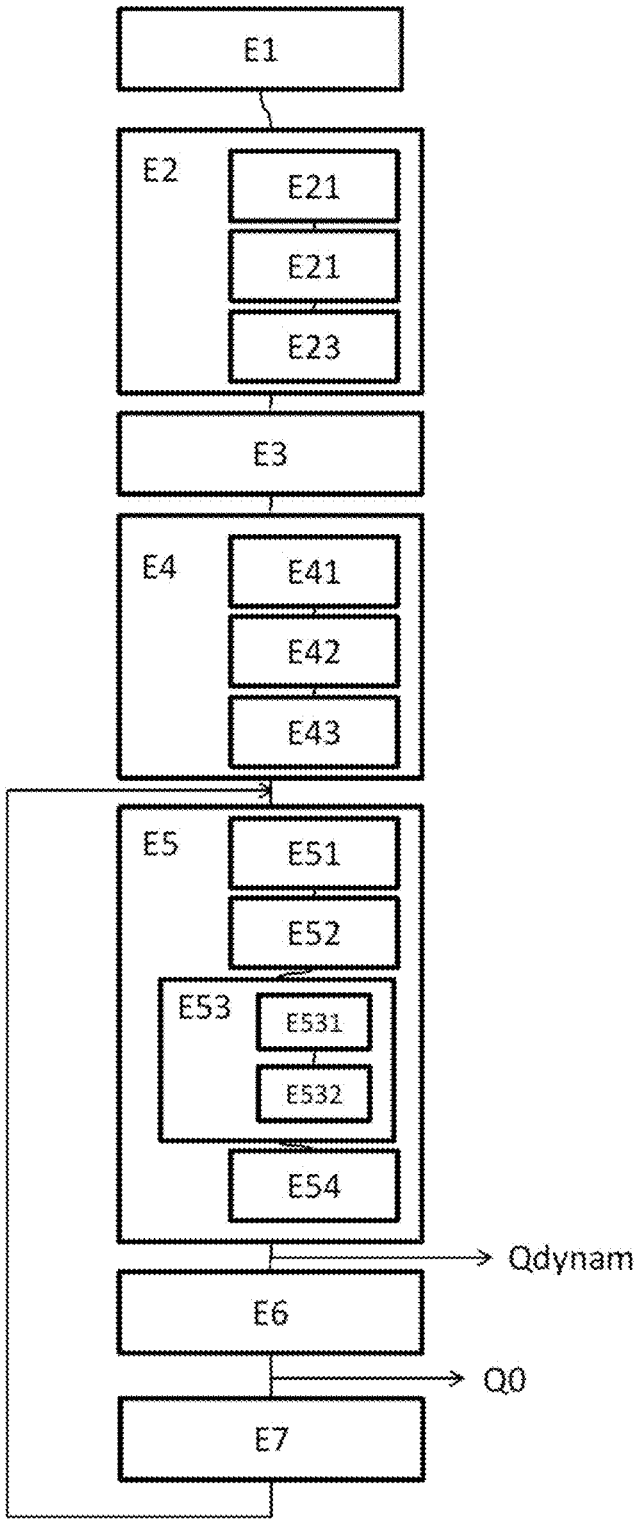
FIG. 6 is a schematic view of various steps of a method for determining a quality factor according to one embodiment of the invention.

One way in which the method for determining a quality factor Q0 of a cavity may be executed will now be described through six steps E1 to E6, which are carried out in succession. As shown in FIG. 6, steps E1 to E5 result in an estimation of a heat load $Q_{dynam}$ on the cryomodule. This estimation is carried out using a state observer based on a thermodynamic and thermohydraulic model of the cryomodule. Next, in step E6, the value of the quality factor $Q_0$ is estimated on the basis of the heat load $Q_{dynam}$.

The method is implemented in real time, i.e. the estimations of the dynamic load $Q_{dynam}$ and of the quality factor $Q_0$ are calculated instantaneously and constantly repeated. By "real time", what is meant is that the determining steps are executed at a rate suited to the variation in the dynamic load $Q_{dynam}$ and in the quality factor $Q_0$. For example, new values of the dynamic load $Q_{dynam}$ and of the quality factor $Q_0$ may be calculated at a frequency higher than or equal to 1 Hz, or even higher than or equal to 10 Hz, or even higher than or equal to 1 kHz. In addition, the method may be carried out while the cavity is in the process of operating, i.e. while the particle accelerator is being used to accelerate particles, in particular for experimental purposes. The method is not necessarily implemented during an operation dedicated to the measurement of quality factor. The method may therefore be implemented parallel to an experiment during which all the systems of the accelerator are in operation. The estimation may also be repeated when a sensor of the cryogenic system records a significant variation.

When not specified in the description, the physical unit associated with a given physical quantity is an SI unit (SI being the well-known abbreviation of International System of Unit).

In a first step E1, characteristics of the phase separator and of the regulating valves are determined. These characteristics depend directly on the design of the cryomodule and of the valves. They may be measured or calculated. These characteristics are:

- the volume of the enclosure containing the cryogenic fluid,
- the static heat load $Q_{static}$ borne by the cryogenic fluid, i.e. the energy transmitted to the cryomodule by heat exchange with the exterior of the cryomodule,
- the function f1 defining the height h of liquid helium as a function of the volume Vliq of liquid helium in the enclosure: h=f1(Vliq). This function depends on the geometry of the enclosure containing the cryogenic fluid. It may be calculated by means of a numerical model of this enclosure or be defined empirically.

For the second valve CV002 and the third valve CV005, these characteristics are:

- The flow coefficient CV of each valve, i.e. the coefficient expressing the flow rate of a fluid passing through a valve, at a given temperature, that causes a given drop in pressure.
- The rangeability Rv of each valve, i.e. the ratio of the maximum and minimum flow rates between which the characteristic of a valve is maintained within certain precision limits.

Figure 7:
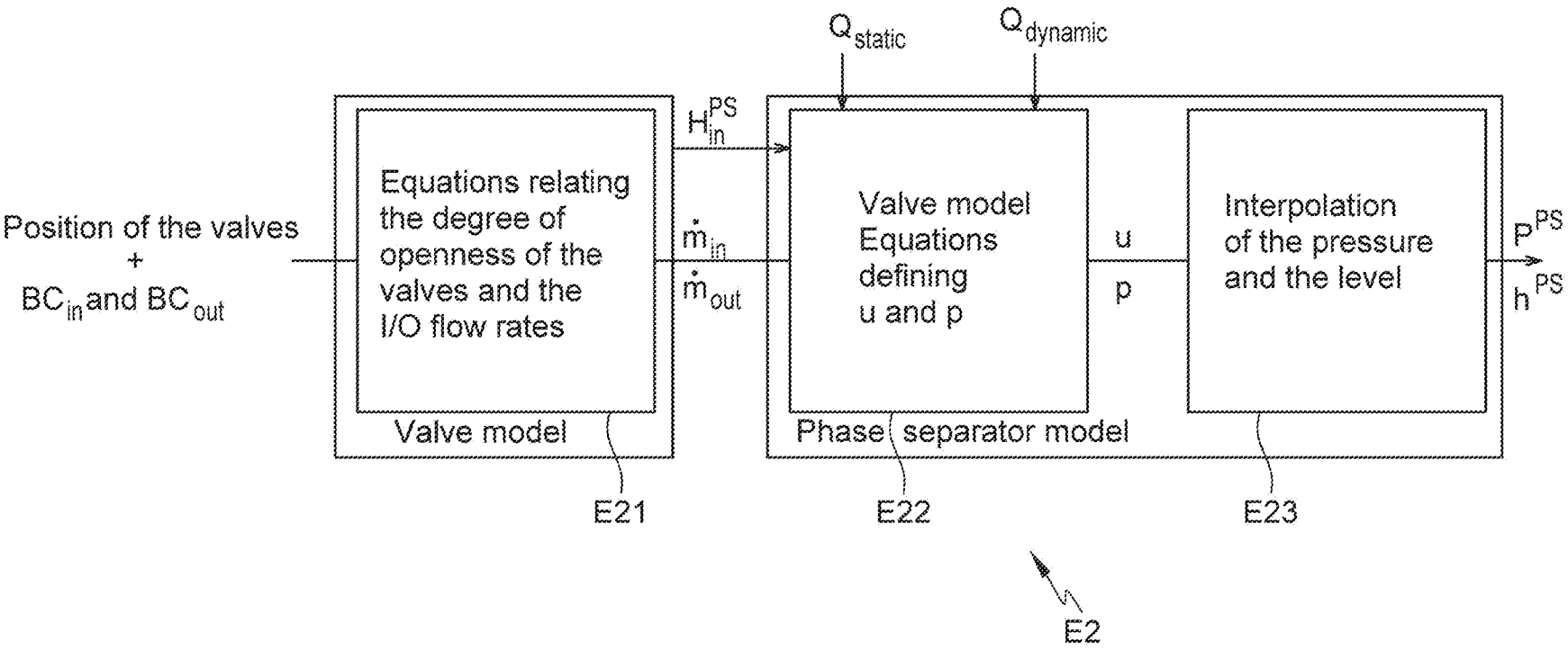
FIG. 7 is a schematic view of a thermodynamic model of the cryomodule.

In a second step E2, a thermodynamic model of the cryomodule is produced. Such a model is illustrated macroscopically in FIG. 7. The thermodynamic model of the cryomodule allows the boundary conditions $BC_{in}$, $BC_{out}$, the positions of the three valves $POS_{CV001}$, $POS_{CV002}$, $POS_{CV005}$, the static load $Q_{static}$, the dynamic load $Q_{dynam}$, the height h of liquid helium in the enclosure, and the internal pressure P in the enclosure 6 to be related by equations. The model may be decomposed into three substeps E21, E22, E23.

In a first substep E21 a model of the valves is established. This first substep E21 allows the amount of helium entering into the enclosure $\dot{m}_{in}$ and the amount of helium exiting from the enclosure $\dot{m}_{out}$ to be defined depending on the boundary conditions $BC_{in}$, $BC_{out}$, and on the positions of the three valves $POS_{CV001}$, $POS_{CV002}$, and $POS_{CV005}$, and on the pressure in the cryomodule.

In a second substep E22 an energy model of a phase separator is established. This second substep allows the density ρ of the helium (expressed in kg/m$^3$) and the specific internal energy u (expressed in J/kg) of the helium contained in the cryomodule to be defined depending on the amount of helium entering into the enclosure $\dot{m}_{in}$ and the amount of helium exiting from the enclosure $\dot{m}_{out}$, on the static load $Q_{static}$, and on the dynamic load $Q_{dynam}$, and on the input and output specific enthalpy $H_{in}$ and $H_{out}$ of the cryomodule or on the output temperature of the cryomodule and on the input mass concentration of the cryomodule.

In a third substep E23 a model of the physical properties of the helium bath is established. This third substep allows the height h of liquid helium in the enclosure, and the internal pressure P in the enclosure to be defined depending on the density ρ of the helium and on the specific energy u of the helium.

We will now describe in detail each of the models established in these three substeps.

The first substep E21 allows a model of the valves to be established. The method will be described in detail through the example of any one particular valve among the three valves CV001, CV002, CV005. Firstly, the expansion that occurs in the valve is considered to be isenthalpic, i.e. without addition of energy from the exterior. Thus, the enthalpy of the helium upstream of the valve is identical to the enthalpy downstream of the valve, i.e.: $H_{out}=H_{in}$. The valve is also considered not to accumulate fluid. Thus, it is also possible to write the equation $\dot{m}_{out}=\dot{m}_{in}$. According to standard ANSI/ISA-75.01.01, the flow rate of a compressible fluid through a valve is written according to the following formula F2:

$$\dot{m}_{comp} = K \cdot CV \cdot \left(1 - \frac{X}{3 \cdot X_C}\right)\sqrt{\rho_{in} \cdot P_{in} \cdot X}$$

in which:

$$X = \min\left(\frac{P_{in} - P_{out}}{P_{in}}, X_C\right)$$

$$X_C = \frac{\gamma}{1.4} \cdot X_t$$

$$X_t = \frac{P_{in} - P_{out}}{P_{in}}$$

where:

- K is a coefficient of conversion between the imperial system of units and the international system of units ($K=7.59\times10^{-3}$).
- $\rho_{in}$ is the density of the helium (expressed in kg/m$^3$) upstream of the valve. This density may be interpolated from a table of a property of helium if the pressure and enthalpy upstream of the valve are known.
- $P_{in}$ is the pressure upstream of the valve (expressed in Pa).
- $P_{out}$ is the pressure downstream of the valve (expressed in Pa).
- γ is the ratio of the specific heats (unitless), defined as the ratio of the specific heat at constant pressure Cp (expressed in J/(kg·K)) to the specific heat at constant volume Cv (expressed in J/(kg·K)) of the helium, i.e.

$$\gamma = \frac{C_p}{C_v}.$$

This ratio may be interpolated from a table of a property of helium if the pressure and enthalpy upstream of the valve are known.

- CV is the flow coefficient of the valve (unitless), which may be calculated using the formula:

$$CV = \frac{CV_{max}}{R_v} \cdot \left(\exp\left(\frac{\text{open}}{100} \cdot R_v\right) - \left(1 - \frac{\text{open}}{100}\right)\right)$$

in which:

$CV_{max}$ is a dimensioning constant of the valve, chosen so that the degree of openness of the valve remains in a suitable operating range (i.e. so that the valve does not open or close 100% during its use).

$R_v$ is the rangeability of the valve (unitless).

"open" is an openness of the valve that varies from 0 when the valve is completely closed to 100 when the valve is completely open. The openness "open" represents the respective open position of each valve $POS_{CV001}$, $POS_{CV002}$, and $POS_{CV005}$ in percent.

Moreover, the flow rate of an incompressible fluid through a valve is written according to the following formula F3:

$$\dot{m}_{incomp}=K\cdot CV\cdot\sqrt{\rho_{in}\cdot(P_{in}-P_{out})}$$

in which the variables have the same meaning as in formula F2.

The isothermal compressibility $\beta_T$ is defined as a factor indicating the variation in the volume of a system when the pressure in the system varies while its temperature remains constant. This factor indicates to what point a fluid is compressible. Thus, $\beta_T=0$ when the fluid is incompressible and $\beta_T=1$ when the fluid is compressible. At a given temperature, the factor $\beta_T$ may be calculated using the following formula:

$$\beta_T=\frac{1}{\rho}\left(\frac{d\rho}{dP}\right)_T.$$

This factor is used to weight the flow rate of the fluid flowing through the valve according to formula F2 or F3 presented above. Thus, the calculation of the flow rate through the valve may be written with the following formula:

$$\dot{m}=\beta_T\cdot\dot{m}_{comp}+(1-\beta_T)\cdot\dot{m}_{incomp}$$

The second substep E22, in which the energy model of the phase separator is established, will now be described in detail. It is assumed that the helium bath is in liquid-gas equilibrium. Therefore, the density ρ of the helium and the specific energy u of the helium (in other words its energy density per unit mass) are distributed uniformly in the enclosure.

Firstly, a physical relationship between the total mass $m_{tot}$ of helium in the bath of the cryomodule, its density ρ and the volume Vol of the enclosure containing the helium is established with the following physical equation:

$$m_{tot}=\rho\cdot Vol$$

This formula may be differentiated so as to be written:

$$\dot{m}_{tot}=\dot{\rho}\cdot Vol$$

Next, a mass balance of the cryomodule allows the total mass $m_{tot}$ of helium inside the enclosure, the entering mass of helium $m_{in}$ and the exiting mass of helium $m_{out}$ to be related by the following equation:

$$\dot{m}_{tot}=\dot{m}_{in}-\dot{m}_{out}$$

The relationship relating the total energy U stored by the helium, the specific energy u of the helium and the total mass $m_{tot}$ of helium is written:

$$U=m_{tot}\cdot u$$

This formula may be differentiated so as to be written:

$$\dot{U}=\dot{m}_{tot}\cdot u+m_{tot}\cdot\dot{u}$$

Lastly, an energy balance applied to the helium bath is written with the following formula:

$$\dot{U}=\dot{m}_{tot}\cdot u+H_{in}\cdot\dot{m}_{in}-H_{out}\cdot\dot{m}_{out}+\Sigma_i Q_i$$

in which equation:

$\Sigma_i Q_i$ is all of the heat loads acting on the helium bath, i.e.:

$$\Sigma_i Q_i=Q_{static}+Q_{dynam}.$$

$H_{in}$ is the enthalpy of the helium entering into the enclosure of the phase separator.

$H_{out}$ is the enthalpy of the helium exiting from the enclosure of the phase separator.

By combining the aforementioned equations, an equation of the thermodynamic model of the cryomodule is obtained:

$$\dot{u}=\frac{H_{in}\cdot\dot{m}_{in}-H_{out}\cdot\dot{m}_{out}+\sum_i Q_i}{\rho\cdot Vol}-u\cdot\frac{\dot{\rho}}{\rho}$$

Lastly, the third substep E23, which allows the height h of liquid helium in the enclosure, and the internal pressure P in the enclosure, to be defined depending on the density ρ of the helium and the specific energy u of the helium, will now be described in detail.

Figure 12A:
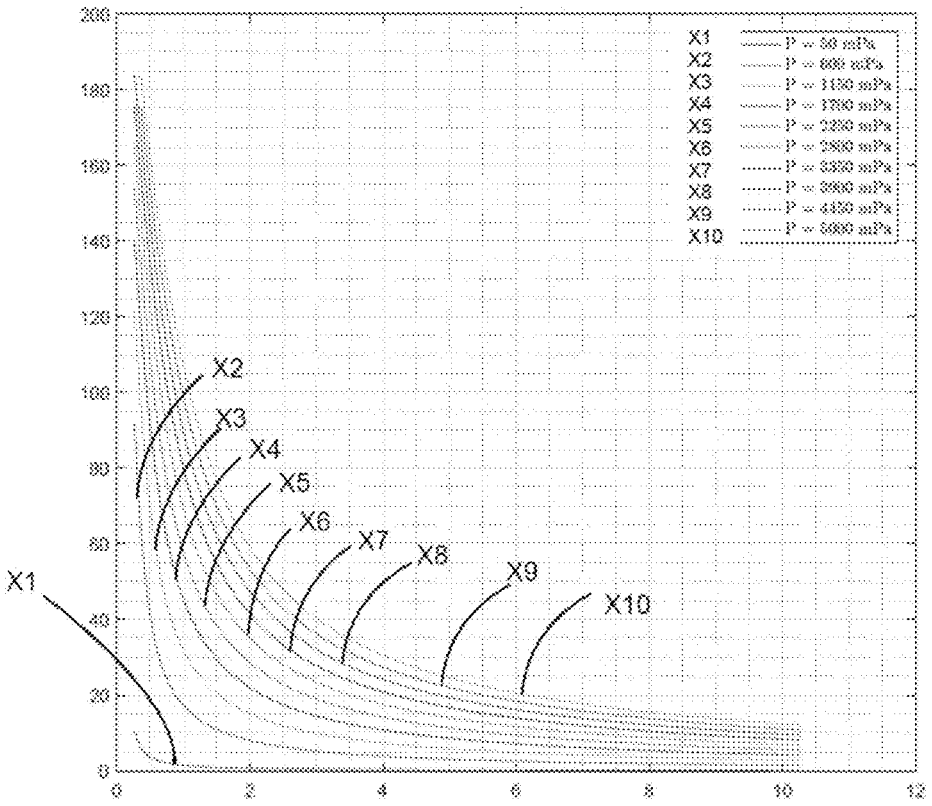
FIGS. 12A, 12B and 12C are tables of properties of helium.

The internal pressure P in the enclosure of the cryomodule may be determined directly depending on the density ρ of the helium and its specific energy u by exploiting the physical properties of helium. To this end, an interpolation function integrated into a simulation software package such as Hepak© and/or a C++ library such as "CoolProp" will possibly advantageously be used. By way of example, a first table of a property of helium is illustrated in FIG. 12A. In this figure, the density ρ of the helium is represented on the y-axis and expressed in $kg/m^3$. The specific energy u is represented on the x-axis and expressed in $10^5\cdot J/kg$. The ten curves X1 to X10 are obtained for ten internal pressure P levels of 50 mPa to 5000 mPa.

Figure 12B:
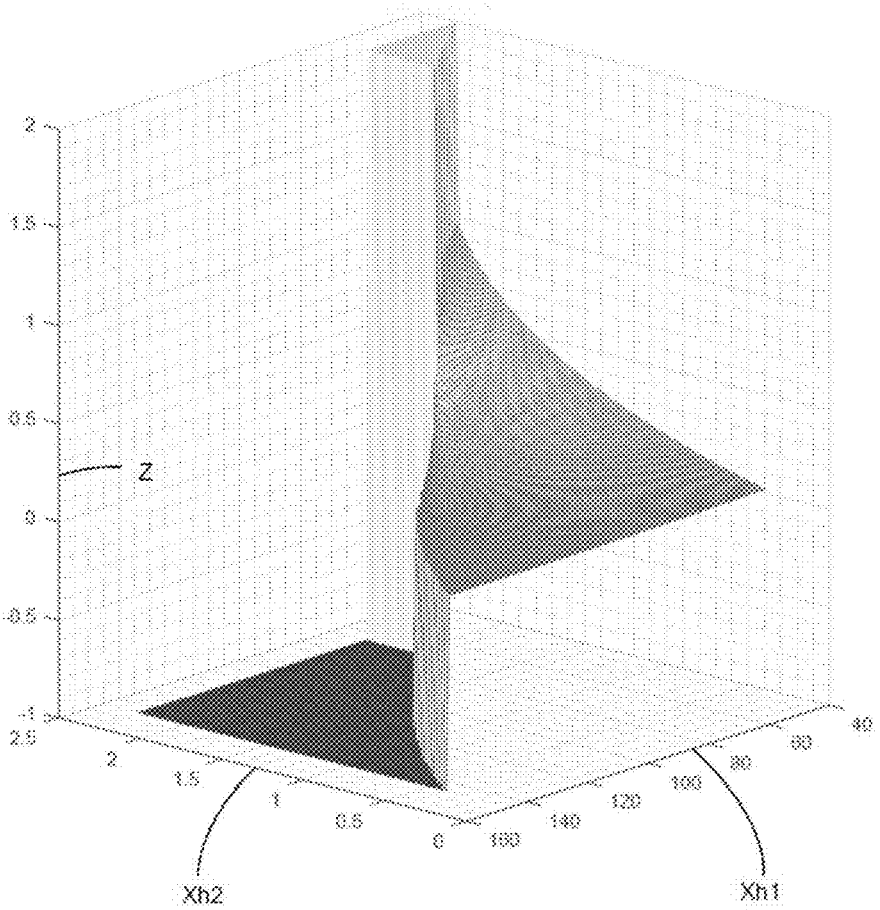

By virtue of a second table of a property of helium, it is also possible to determine the mass concentration X of the helium depending on the density ρ of the helium and its specific energy u. This second table is shown by way of example in FIG. 12B. The mass concentration X is represented on the vertical axis Z. The density ρ of the helium is represented on a first horizontal axis Xh1 and is expressed in $kg/m^3$. The specific energy u is represented on a second horizontal axis Xh2 and expressed in $10^4\cdot J/kg$. By definition, the mass concentration X of the helium respects the following formula:

$$m_{liq}=m_{tot}(1-X)$$

in which formula $m_{liq}$ is the mass of the liquid helium in the enclosure and $m_{tot}$ the total mass of helium.

The volume of helium in liquid form $V_{liq}$ is defined by the equation:

$$V_{liq}=\frac{m_{liq}}{\rho_{liq}}$$

in which $\rho_{liq}$ is the density of the liquid helium.

Figure 12C:
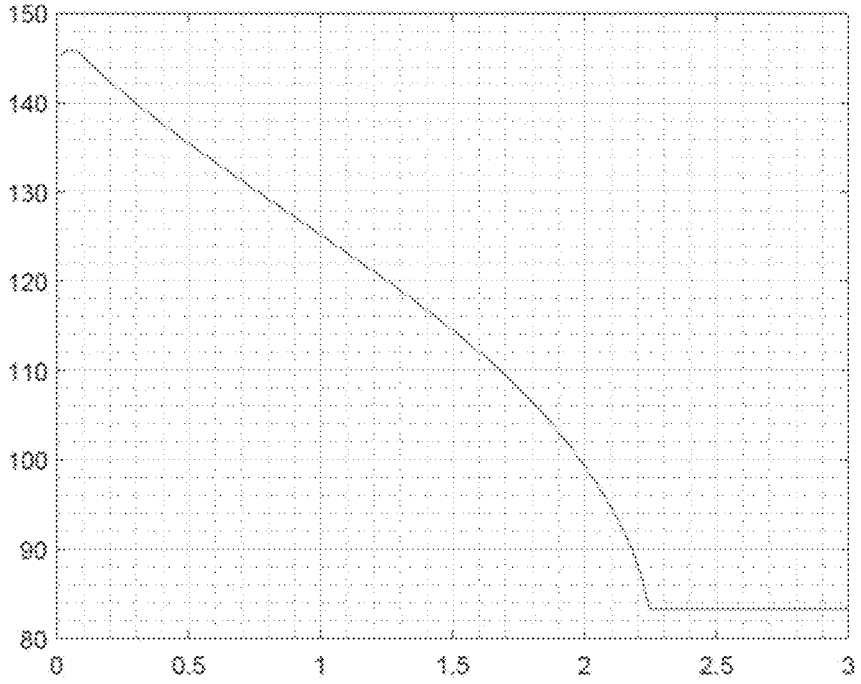

Lastly, by virtue a third table of a property of helium, which is illustrated by way of example in FIG. 12C, and considering the helium to be in the saturated liquid state, it is also possible to determine the density of the liquid helium $\rho_{liq}$ (on the y-axis) as a function of internal pressure P (on the x-axis). In this figure, the density of the liquid helium $\rho_{liq}$ is expressed in kg/m$^3$ and the internal pressure P is expressed in $10^5$·Pa. It will be noted that by "saturated liquid" what is meant is a liquid the temperature and pressure of which are such that, at constant temperature, any, even the most infinitesimal, loss of pressure causes the liquid to boil. Finally, the volume of helium in liquid form $V_{liq}$ is determined then the height h of liquid helium is calculated using the function $f_1$ defined above.

Finally, by virtue of the three substeps E21, E22, E23 described above, a thermodynamic model of the cryomodule is obtained, this model relating, via the equations, the boundary conditions $BC_{in}$, $BC_{out}$, the positions of the three valves $POS_{CV001}$, $POS_{CV002}$, $POS_{CV005}$, the static load $Q_{static}$, the dynamic load $Q_{dynam}$, the height h of liquid helium in the enclosure and the pressure P in the enclosure.

Figure 8A:
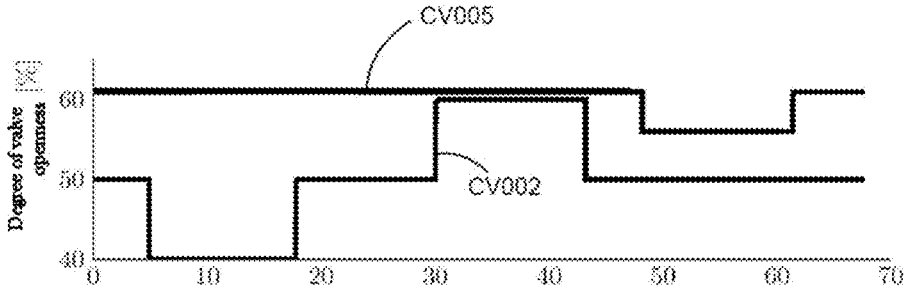
FIGS. 8A, 8B and 8C are graphs illustrating the precision of a thermodynamic model according to one embodiment of the invention.
Figure 8B:
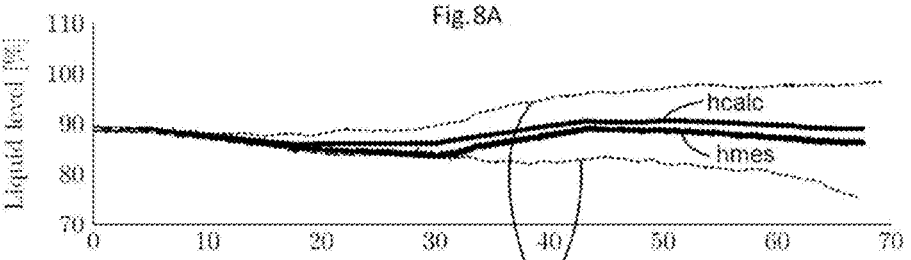
Figure 8C:
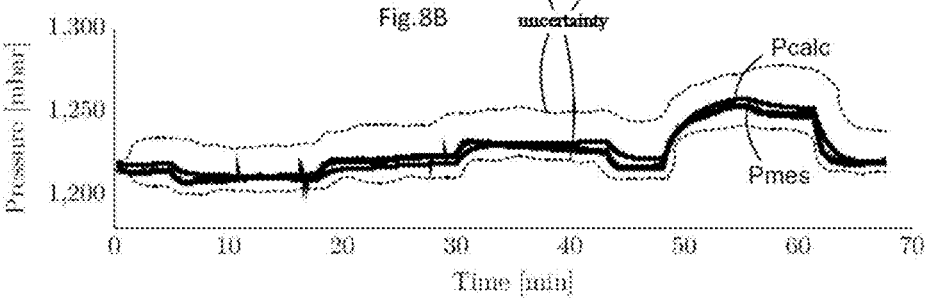

The precision of the thermodynamic model of the cryomodule may be verified by comparing the measured height of liquid helium $h_{mes}$ with the height of liquid helium $h_{calc}$ estimated using the model, and likewise by comparing the pressure measured in the enclosure $P_{mes}$ with the pressure $P_{calc}$ estimated using the model, when the degree of openness of the valves CV002 and CV005 is varied. For the sake of this verification, the dynamic heat load $Q_{dynam}$ will possibly be kept at a zero value and the valve CV001 kept shut. FIG. 8A illustrates a graph of the degree of openness of the valves CV002 and CV005 as a function of time (the value of 100% indicating a completely open valve). FIG. 8B illustrates the variation over time in the measured and estimated heights $h_{mes}$ and $h_{calc}$ of liquid helium. The two dashed curves represent the calculation of an uncertainty. More precisely, the two dashed curves represent the heights of liquid helium estimated with a degree of openness of the valves increased by 2% and decreased by 2%, respectively. It may be seen that the calculated height of liquid helium $h_{calc}$ differs by no more than a few percent from the measured height of liquid helium $h_{mes}$. Likewise, FIG. 8C illustrates the variation over time in the measured and estimated helium pressures $P_{mes}$ and $P_{calc}$. The two dashed curves also represent the calculation of an uncertainty obtained by simulating a degree of openness of the valves increased by 2% and decreased by 2%, respectively. It may be seen that the simulated helium pressure $P_{calc}$ differs by no more than a few millibar from the measured helium pressure $P_{mes}$. This verification therefore allows the precision of the thermodynamic model established to be validated.

In a third step E3, various parameters of the cryogenic system are stored in the memory of the programmable logic controller PLC. In particular, the internal pressure P delivered by the pressure sensor PT is stored. The height h of liquid helium in the enclosure, which is delivered by the level sensor LT is also stored. The boundary conditions are also stored, i.e.:

- the helium pressure $P_{in}$ upstream of the admission valves CV001, CV002,
- the helium pressure $P_{out}$ downstream of the outlet valve CV005,
- the input specific enthalpy of the supply valve: $H_{in}$.

The boundary conditions are dependent on the helium distribution circuit 11 and may be measured and/or calculated by means of suitable sensors positioned in the distribution circuit 11. As a variant, and to simplify the calculations, the boundary conditions could be considered to be constant Such a simplification however leads to a less precise estimation of the dynamic load.

The thermodynamic model of the cryomodule obtained at the end of the second step E2 comprises equations that are complex to solve. In order to facilitate the solution of these equations, the invention makes provision, in a fourth step E4, for a linearization of the thermodynamic model, i.e. for an approximation of the thermodynamic model by a set of differential equations that are linear about a preset operating point.

In a first substep E41, an operating point about which the model will be linearized is defined. This operating point may be determined depending on constraints that the cryomodule must respect. For example, it is possible to define the operating point by an internal pressure P of the helium bath equal to 1200 mbar and a height of liquid helium equal to 90% of the total height of the enclosure.

In a second substep E42, the boundary conditions $BC_{in}$ and $BC_{out}$ of the system are defined and the opennesses $POS_{CV001}$, $POS_{CV002}$, $POS_{CV005}$ of the valves that allow the model to stabilise to the operating point defined beforehand are sought. The openness of the first valve $POS_{CV001}$ may be set to 0% (i.e. completely closed) because this valve is used only to fill the enclosure. Two PID regulators (PID being the well-known acronym of proportional-integral-derivative) may be used to determine the opennesses $POS_{CV002}$, $POS_{CV005}$ of the two other valves. In this step, the radiofrequency antenna may or may not be activated, depending on the operating point about which it is desired to linearize the thermodynamic model.

In a third substep E43, the thermodynamic is represented as a linear dynamic system. The linear system is defined by the following state representation:

$$\dot{x} = A \cdot x + B \cdot \begin{pmatrix} v \\ w \end{pmatrix}$$

$$y = C \cdot x + D \cdot \begin{pmatrix} v \\ w \end{pmatrix}$$

with

A, B, C and D state matrices of the system, v a vector of controllable inputs defined by:

$$v = \begin{pmatrix} \dot{m}_{in} \\ \dot{m}_{out} \end{pmatrix}$$

$\dot{m}_{in}$ being the mass flow rate entering into the cryomodule.

$\dot{m}_{out}$ being the mass flow rate exiting from the cryomodule.

w a vector of uncontrollable inputs defined by:

$$w = \begin{pmatrix} Q_{static} \\ Q_{dynam} \\ H_{in} \end{pmatrix}$$

$Q_{static}$ being the static load, $Q_{dynam}$ being the dynamic load and $H_{in}$ being the enthalpy within the cryomodule.

x a state vector, the latter being equal to the output vector y and being defined by:

$$x = y = \begin{pmatrix} u \\ \rho \end{pmatrix}$$

where ρ the density of the helium and u its specific internal energy.

This linear system describes the dynamics of the method about the operating point defined in substep E41 and defined by:

$$v_0 = \begin{pmatrix} \dot{m}_{in}(nom) \\ \dot{m}_{out}(nom) \end{pmatrix}$$

$$w_0 = \begin{pmatrix} Q_{static}(nom) \\ Q_{dynam}(nom) \\ H_{in}(nom) \end{pmatrix}$$

$$x_0 = y_0 = \begin{pmatrix} u(nom) \\ \rho(nom) \end{pmatrix}$$

By virtue of the thermodynamic module established beforehand in the second step E2, it is possible to determine the values of the state matrices of the system, A, B, C and D. To this end, it is possible to use a linearization function of a computational tool such as the "linearize" function of Matlab®. In practice, as x=y, the state matrix C is equal to a unit matrix and the state matrix D is equal to a zero matrix. The linear system thus obtained describes the thermodynamic behaviour of the cryomodule about the operating point defined in substep E41.

In a fifth step E5, a heat-load observer OBS such as illustrated in FIG. 8 is set up. The inputs of the model are the height h of liquid helium, the internal pressure P of the helium bath, the helium pressure $P_{out}$ downstream of the outlet valve CV005, the helium pressure $P_{in}$ upstream of the inlet valves CV001 and CV002, the positions of the three valves $POS_{CV001}$, $POS_{CV002}$, $POS_{CV005}$, and the enthalpy $H_{in}$ of the helium upstream of the inlet valves. All these inputs are measured with the exception of $H_{in}$, the value of which is estimated using two sensors located upstream of the cryomodule.

In a first substep E51, the signals delivered by the sensors, are filtered so as to decrease noise. A first order filter of the following form may be used:

$$H(p) = \frac{1}{1 + \tau_{filter} \cdot p}$$

in which $\tau_{filter}$ is a time constant of the filter, chosen depending on a time constant $\tau_{method}$ of the method, such that:

$$\tau_{filter} \ll 5 \cdot \tau_{method}$$

In a second substep E52, the density ρ and the internal energy u of the helium bath are calculated based on the level of liquid helium h and the internal pressure P in the enclosure. Initially, the volume of liquid helium $V_{liq}$ is calculated based on the measurement of the level using the formula $V_{liq}=f_1(h)$, in which $f_1$ is the function giving the volume of liquid helium $V_{liq}$ depending on the height indicated by the level sensor LT. Based on the volume of liquid helium it is possible to deduce the mass concentration X of the fluid contained in the cryomodule using the formula:

$$X = \frac{m_{gas}}{m_{gas} + m_{liq}} = \frac{\rho_{gas} \cdot V_{gas}}{\rho_{gas} \cdot V_{gas} + \rho_{liq} \cdot V_{liq}}$$

in which $m_{gas}$, $\rho_{gas}$, $V_{gas}$ are respectively the mass, density and volume of the helium in gaseous form, and $m_{liq}$, $\rho_{liq}$, $V_{liq}$ are respectively the mass, density and volume of the helium in liquid form.

As explained above, since it is a question of a saturated liquid, the density $\tau_{liq}$ of liquid helium may be determined by virtue of the third table of a property of helium, depending on the internal pressure P.

Analogously, since it is a question of a saturated liquid, the density $\rho_{gas}$ of the gaseous helium may be determined by virtue of the fourth table of a property of helium, depending on the internal pressure P.

It is thus possible to calculate the mass concentration X, then, based on fifth and sixth tables of properties of helium, to deduce therefrom the density ρ and the internal energy u of the helium bath, respectively.

Figure 9:
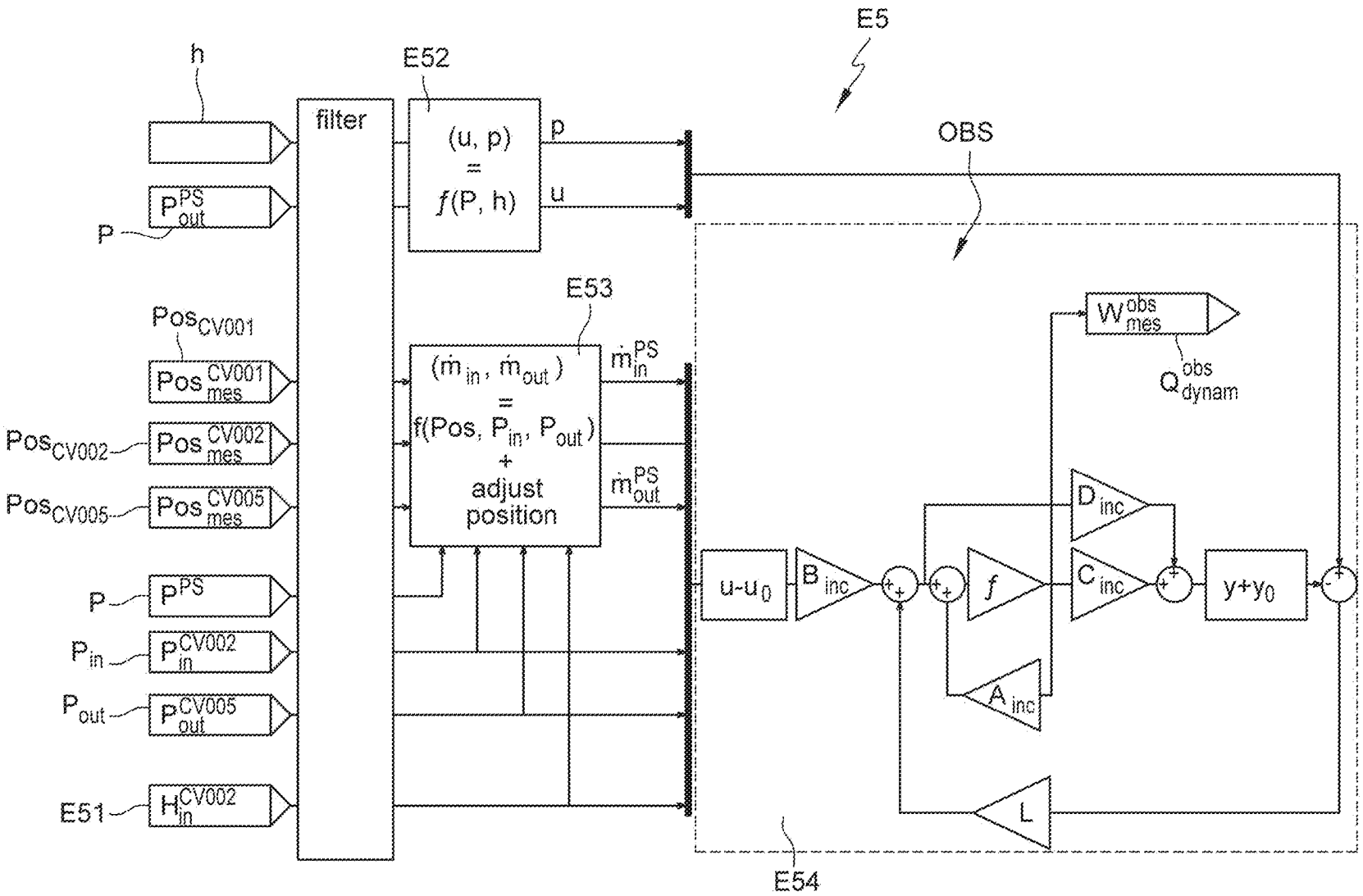
FIG. 9 is a schematic view of a heat-load observer of the cryomodule.

In a third substep E53, the flow rate ṁ through each of the valves CV001, CV002 and CV005 is calculated in accordance with the logic diagram illustrated in FIG. 9. This calculation comprises a first substep E531 of adjusting the measurement of the position of a valve and a second substep E532 of calculating the mass flow rate through a valve by means of the model established in substep E21.

The substep E531 aims to compensate for deviations and drifts observed between the simulated mass flow rate and the observed mass flow rate through a valve CV00*i* (i being equal to 1, 2 or 5 depending on the valve in question). In order to compensate for a deviation between the simulated mass flow rate and the observed mass flow rate, a static offset $CV00i_{offset_{stat}}$ is defined, which is applied to the measurement of the position of valve i via the following formula:

$$CV00i_{offset_{stat}} = CV00i_{pos_{mes}}{}^{nom} - CV00i_{pos_{sim}}{}^{nom}$$

where:

$CV00i_{pos_{mes}}{}^{nom}$ is the measured nominal value of the position of value i at the operating point defined in substep E41.

$CV00i_{pos_{sim}}{}^{nom}$ is the simulated nominal value of the position valve i at the operating point defined in substep E41.

In order to correct a drift of the mass flow rate through the valve, it is also possible to define a dynamic offset by the following formula:

$$CV00i_{offset_{dyn}} = (CV00i_{pos_{mes}} - CV00i_{pos_{mes}}{}^{nom}) \cdot gain$$

where:

$CV00i_{pos_{mes}}$ is the current measured value of the position of valve i.

$CV00i_{pos_{mes}}{}^{nom}$ is the measured nominal value of the position of valve i at the operating point defined in substep E41.

gain is a coefficient of proportionality to be adjusted based on measurements carried out on the system.

The corrected position $CV00i_{pos_{corr}}$ of the valve CV00*i* may then be obtained by adding the measured position, the static offset and the dynamic offset, i.e. via the following equation:

$$CV00i_{pos_{corr}} = CV00i_{pos_{mes}} + CV00i_{offset_{stat}} + CV00i_{offset_{dyn}}$$

Figure 10:
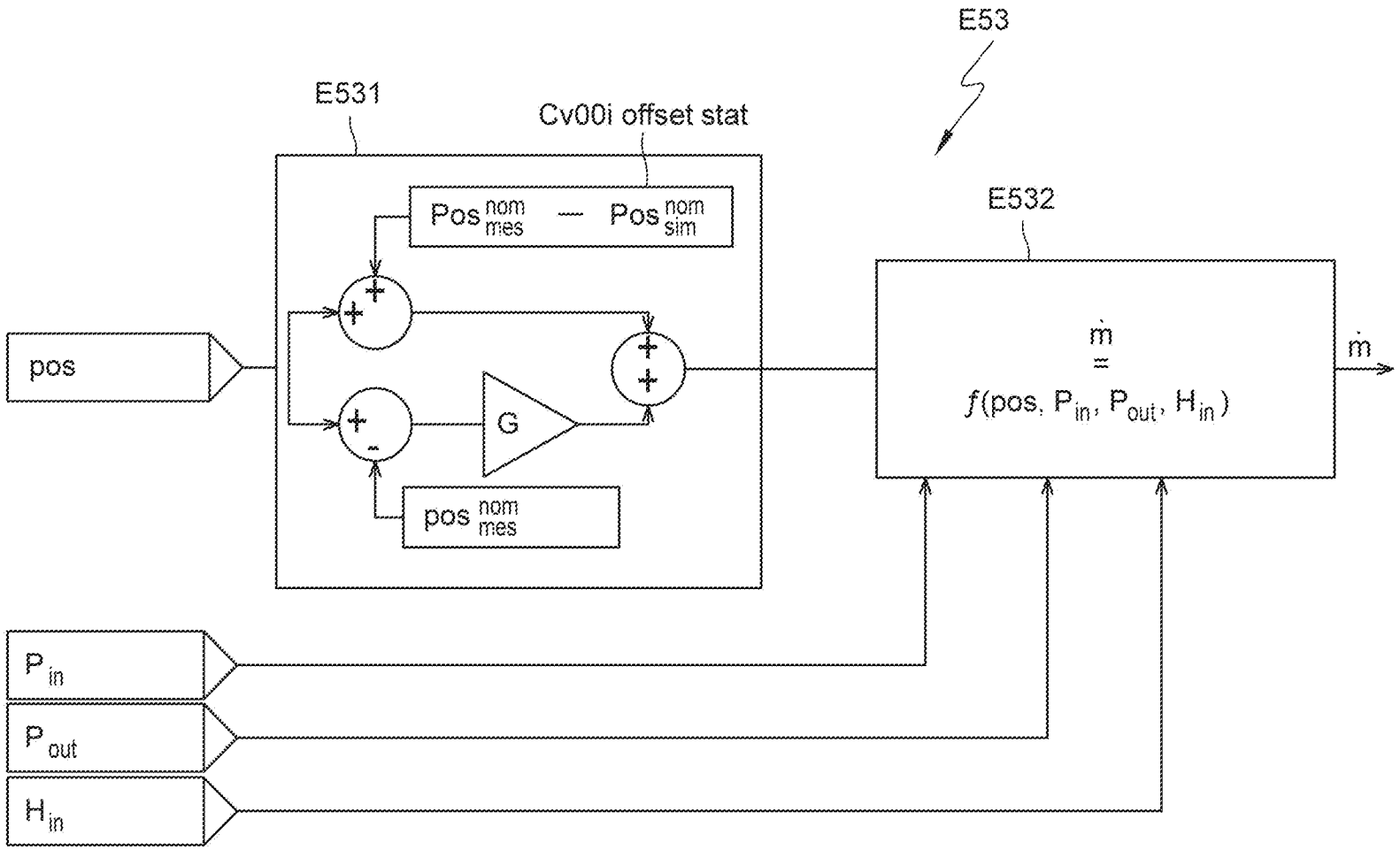
FIG. 10 is a schematic view of a model of a flow rate through a valve of the cryogenic system.

The block referenced E531 in FIG. 10 illustrates a logic diagram allowing the formula for calculating $CV00i_{pos_{corr}}$ defined above to be implemented.

In the second substep E532, the model established in substep E21 is used. This model allows the mass flow rate through a valve CV00*i* to be calculated depending on the corrected position $CV00i_{pos_{corr}}$ of the valve CV00*i* calculated beforehand, on the pressure $P_{in}$ upstream of the valve, on the pressure $P_{out}$ downstream of the valve and on the enthalpy $H_{in}$ upstream of the valve (which is assumed to be identical to the enthalpy downstream of the valve). Substep E53 is then repeated for each of the valves CV001, CV002 and CV005 of the system so as to determine the mass flow rate through each of these valves depending on the current measured value $CV00i_{pos_{mes}}$ of the position of valve i.

In a substep E54, a state observer, referred to as the Kalman observer, is implemented in accordance with the diagram defined in FIG. 8. The state observer comprises the state matrices A, B, C and D defined in substep E43. L is the gain of the observer calculated for the system. The block consisting of the symbol ∫ represents an integrator.

The resulting system is an invariant linear system, for which there is a Kalman estimator obtained by solving a Riccati difference equation, for example using the "lqr" function of Matlab® with L==lqr (A, C, Q, R) in which Q and R are weighting matrices. In other words, it is a question of finding the gain L that minimizes the following criterion:

$$J=\Sigma_{k=1}^{\infty} x^T Qx+u^T Ru, \text{ with } u=-Lx$$

For example, the matrices Q and R may be written in the following form:

$$Q = \begin{bmatrix} 1e2 & 0 \\ 0 & 1e3 \end{bmatrix}$$

$$R = \begin{bmatrix} 1e3 & 0 & 0 & 0 \\ 0 & 1e3 & 0 & 0 \\ 0 & 0 & 1e2 & 0 \\ 0 & 0 & 0 & 1e2 \end{bmatrix}$$

The state observer thus implemented allows the dynamic load $Q_{dynam}$ to be determined and observed in real time.

Figure 11A:
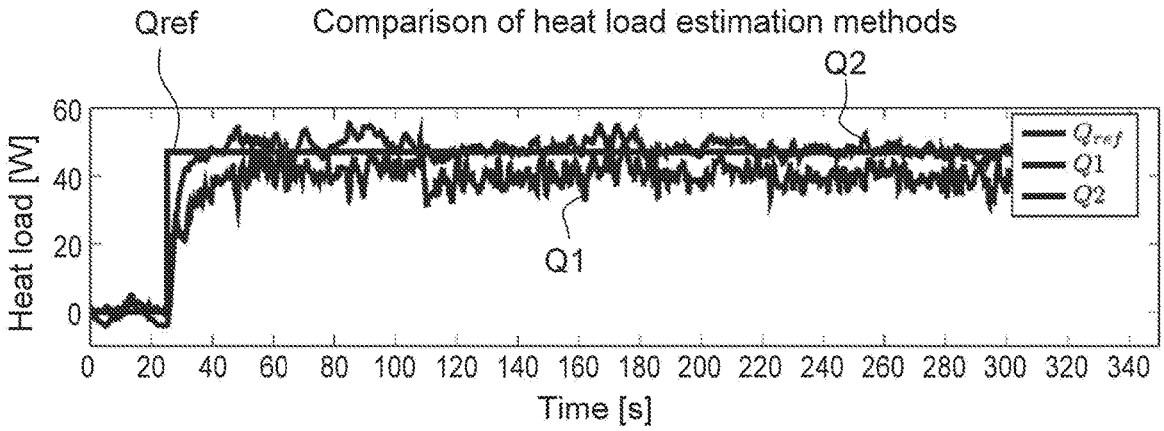
FIGS. 11A and 11B are graphs illustrating the precision of an estimation of a dynamic load applied to the cryomodule.
Figure 11B:
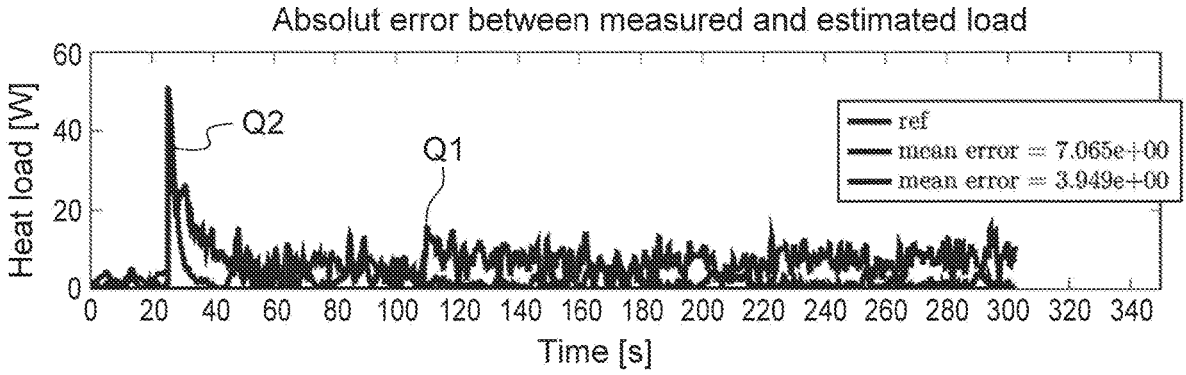

Advantageously, the calculating method thus developed may be validated by means of an experiment on a cryogenic system when the latter comprises a cavity equipped with a device for generating heat such as a resistive heater of variable supply, also referred to as a "Joule heater". Such a heater allows a supply of heat identical to that which would be produced by the operation of the cavity in a particle accelerator to be simulated. The resistive heater delivers heat equivalent to a dynamic heat load $Q_{dynam}$. FIG. 11A is a graph showing, as a function of time, the power $Q_{ref}$ delivered by the resistive heater, the dynamic heat load Q1 calculated without applying processing to the nonlinearities (i.e. using the complete linear model of the cryomodule, integrating the model of the valves and the calculation of the level of liquid of the bath), and the dynamic heat load Q2 calculated by the state observer described above. It may be seen that the power $Q_{ref}$ delivered by the resistive heater is stable at a value of 47 W. The calculated value of the dynamic heat load Q1 oscillates about a power of about 40 W. The calculated value of the dynamic heat load Q2 oscillates about a power of about 47 W and converges more rapidly to this value when the resistive heater is activated. The transitory regime of the dynamic heat load Q1 is decreased by 20 to 30 seconds in comparison to the dynamic heat load Q2. FIG. 11B is a graph representing, as a function of time, the error in the estimation of the dynamic heat load Q1 and of the dynamic heat load Q2. The error is larger for the calculation of the dynamic heat load Q1 than for the calculation of the dynamic heat load Q2. This experiment therefore shows that the dynamic heat load determined by the state observer according to the invention is precise and reliable.

In a sixth step E6, the quality factor $Q_0$ of the cavity 4 is calculated. The quality factor is a measure of the damping ratio of an oscillating system. The quality factor depends on the temperature T of the internal wall of the cavity, which is assumed to be uniform, on the material of the cavity and on its geometric shape. It is defined by the ratio of the energy U stored in the cavity to the energy $P_{loss}$ dissipated in the walls of the cavity, per period of oscillation. The quality factor may therefore be expressed by the following formula:

$$Q_0(T) = \frac{\omega \cdot U}{P_{loss}}$$

in which ω is the resonant angular frequency of the cavity.

To calculate the energy U stored in the cavity and the energy $P_{loss}$ dissipated in the walls of the cavity it is assumed that there is a perfect vacuum in the cavity and that the resistivity of the walls of the cavity is uniform over all of their surfaces. In light of the fact that the energy stored in the electric field is equal to the energy stored in the magnetic field, and of the fact that the internal energy of the cavity is calculated over the volume and that the losses are concentrated on the surface of the cavity, it is possible to express U and $P_{loss}$ via integrals over the volume of the cavity and over the surface of the walls of the cavity, respectively. U and $P_{loss}$ may therefore be expressed using the following formulae:

$$U = \frac{1}{2}\mu_0 \int_v |H|^2 dv$$

$$P_{loss} = \frac{1}{2} R_s(T) \oint_s |H|^2 ds$$

in which formulae:

$\mu_0$ is the magnetic permeability of free space, $R_s$ is the surface resistance of the cavity, the value of which depends on the temperature of the cavity, H is the magnetic field inside the cavity.

Thus, the quality factor $Q_0$ may be expressed in the following form:

$$Q_0(T) = \frac{G}{R_s(T)}$$

where G is called the geometry factor of the cavity, and is defined by:

$$G = \omega \cdot \mu_0 \frac{\int_v |H|^2 dv}{\oint_s |H|^2 ds}$$

The geometry factor G is a known and invariant datum that may be calculated directly from a radiofrequency model of the cryomodules. Considering the geometry factor G to be known, it is still necessary to find the expression of the surface resistance $R_s(T)$ in order to be able to deduce the quality factor therefrom. The surface resistance $R_S(T)$ respects the following equation:

$$R_S(T)=R_{BCS}(T)+R_{res}$$

in which equation:

$R_{res}$ is the residual resistance of the niobium, $R_{BCS}(T)$ is a variable resistance defined by the following equation:

$$R_{BCS}(T) = \frac{A}{T} \cdot f^2 \cdot \exp\left(\frac{-\Delta}{k_B \cdot T}\right)$$

in which equation:

T is the temperature of the internal wall of the cavity,

A is a constant dependent on the properties of the material used to manufacture the walls of the cavity (niobium in particular), f is the resonant frequency of the cavity, Δ is the energy gap of the material used to manufacture the walls of the cavity, $k_B$ is Boltzmann's constant.

Among all these parameters, only the temperature T is unknown and subject to variations. All the other parameters A, f, Δ, $k_B$ are set values that are known or measurable.

The temperature T of the internal wall of the cavity may be estimated from the power dissipated in the cavity and the temperature of the helium bath. Specifically, the heat dissipated on the interior surface of the cavity is transmitted to the helium bath by conduction through the niobium walls of the cavity. Assuming that the cavity dumps all its heat into the helium bath, the energy $P_{loss}$ dissipated in the walls of the cavity may be deduced to be equal to the dynamic heat load $Q_{dynam}$.

Moreover, an equation of thermal conduction applied to the walls of the cavity is expressed in the following way:

$$P_{loss} = \frac{\lambda(T) \cdot S}{e} \cdot (T_{cavity} - T_{bath}) = Q_{dynam}$$

in which equation:

λ(T) is the thermal conductivity of niobium,

S is the area of the exchange surface between the cavity and the helium bath e is the thickness of the wall of the cavity, $T_{cavity}$ is the temperature of the internal wall of the cavity, $T_{bath}$ is the temperature of the helium bath.

Since it is a question of a saturated liquid, the temperature $T_{bath}$ of the helium bath may be interpolated from a table of a property of helium if the internal pressure P of the helium bath (regulated about a value of 1200 mbar) is known.

It will be noted that the internal pressure of the helium bath is assumed to be uniform in this model. The model could be refined by considering the pressure as a function of the height of the point in question in the helium bath. It would then be possible to define a temperature gradient in the helium bath rather than to consider the temperature to be uniform.

Finally, as the thermal conductivity of niobium λ(T), the area S of the exchange surface between the cavity and the helium bath, and the thickness e of the wall of the cavity are known quantities, and as an estimation of the dynamic heat load $Q_{dynam}$ is available (delivered by the state observer) it is possible to calculate the temperature $T_{cavity}$ of the internal wall of the cavity. Once this temperature has been determined, it is possible to calculate the value of the variable resistance $R_{BCS}(T)$, then the surface resistance $R_S(T)$, and lastly the quality factor $Q_0$.

Finally, the quality factor Q0 may be expressed by the following formula:

$$Q_0 = G \Big/ \left( \frac{A}{Q_{dynam} \cdot \frac{e}{\lambda(T) \cdot S} + T_{bath}} \cdot f^2 \cdot \exp\left( \frac{-\Delta}{k_B \cdot \left( Q_{dynam} \cdot \frac{e}{\lambda(T) \cdot S} + T_{bath} \right)} \right) + R_{res} \right)$$

The invention also relates to a method for operating a particle accelerator comprising implementing the method for determining the quality factor Q0 such as described above, and in particular steps E4 to E6, and a step E7 of modifying at least one operating parameter of the accelerating cavity depending on the quality factor Q0. For example, the operating parameter may be a setpoint value of the power of a radiofrequency wave emitted in the cavity by the antenna 8. The modification may consist in decreasing the value of the power setpoint until the emission of the radiofrequency wave stops if the quality factor of at least one accelerating cavity crosses a preset threshold, the other cavities of the accelerator, when they exist, being able to continue to operate. The decrease in the value of the setpoint may optionally be continued until the emission of the radiofrequency wave stops. The invention may also be implemented while the particle accelerator is being powered up, the value of the setpoint for example being gradually increased depending on the determined quality factor. The modification may also consist in any other modification of the configuration and/or of the regulation of the particle accelerator.

Concretely, the regulating means 12, which is incorporated into the programmable logic controller PLC, may for example compare the estimation of the quality factor with a threshold value. If the quality factor Q0 is higher than a preset threshold, then the regulating means 12 may send a control signal to the radiofrequency system in order to decrease the power of the waves emitted by the radiofrequency antenna 8 integrated into the cavity. The regulating means 12 may optionally comprise a plurality of thresholds beyond which the power of the waves emitted by the radiofrequency antenna will be successively decreased until a power of zero is reached. Thus, it is possible to use each cavity at a power that is optimal given its quality factor without having any impact on the operation of the other cavities of the particle accelerator. Preferably, the operating method comprises a plurality of iterations of steps E4 to E7.

During operation, the control structures CTRL and Coord illustrated in FIGS. 4A, 4B, 4C and 4D use the estimation of the heat load on the helium bath to regulate the degree of openness of the valves CV002 and CV005 and to keep the cryomodule at about an optimal operating point.

CONCLUSION

The measuring principle illustrated through this invention is fundamentally different from the conventional measurement because it is based on the thermal state of the bath of cryogenic fluid in which the cavity is submerged and not on a direct measurement of the radiofrequency field in the cavity.

The heat load is estimated using sensors that belong to the cryogenic system, and the determination of the quality factor $Q_0$ does not require a pick-up probe, a network analyser or any other dedicated means for determining quality factor. In addition, the estimation of the quality factor is carried out during operation (and not off-line). This determination may be carried out in real time or not in real time, but in any case during the operation of the particle accelerator, which was not the case in the prior art. In other words, the invention allows the accelerating potential of an accelerating cavity (the maximum power that it is able to accept) at any time to be estimated and the power emitted by the radiofrequency antenna to be adjusted accordingly. This estimation does not require any physical modification of the existing system, i.e. it does not require sensors or any other measuring devices to be added, and also does not require knowledge of a voltage applied to the cavity. Knowledge of the quality factor, in particular in real time, allows the stability of both the cryogenic behaviour and the behaviour of the radiofrequency system acting on the cavity to be improved with a view to achieving reliable operation of the accelerator. The device achieved is sufficiently economical in computational resources to be able to be implemented via a programmable logic controller.

The method according to the invention is executable from the moment that radiofrequency power is injected into the superconducting cavities and even before a beam has been formed. It is also executable with the beam and it allows certain possible anomalies that cause an abnormal heat load to be placed on the cavities to be diagnosed.

The invention claimed is:

1. A method for determining a quality factor of an accelerating superconducting cavity of a particle accelerator, the method comprising:

determining a heat load to which a cryomodule having the accelerating cavity and a bath of cryogenic fluid is subjected; and determining a quality factor based on the determination of the heat load while the particle accelerator is being used to accelerate particles, wherein the determining the heat load comprises the use of a state observer based on a thermodynamic and thermohydraulic model of the cryomodule.

2. The method according to claim 1, wherein the determining the heat load and determining the quality factor are carried out simultaneously and in real time.

3. The method according to claim 1, wherein the use of the state observer comprises an estimation of a mass flow rate ($\dot{m}$) of cryogenic fluid passing through a valve of the cryomodule taking a form $$\dot{m}=\beta_T\cdot\dot{m}_{comp}+(1-\beta_T)\cdot\dot{m}_{incomp}$$

in which:

$\dot{m}_{comp}$ is a mass flow rate of cryogenic fluid in compressible form through a valve, $\dot{m}_{incomp}$ is the mass flow rate of cryogenic fluid in incompressible form through the valve, and $\beta_T$ is a coefficient of isothermal compressibility of the cryogenic fluid.

4. The method according to claim 1, wherein the state observer comprises an estimation of a density and of a specific internal energy of a bath of cryogenic fluid.

5. The method according to claim 4, wherein the estimation is carried out based on:

a volume of the cryogenic fluid in a liquid state, which is calculated based on a measurement of a height of the cryogenic fluid in the liquid state; and a static heat load and a dynamic heat load received by the bath of cryogenic fluid; and an input specific enthalpy and an output specific enthalpy of the cryogenic bath, based on a measurement of a pressure of the bath of cryogenic fluid.

6. A method for operating a particle accelerator, having at least one accelerating cavity, the operating method comprising implementing the method for determining a quality factor of at least one accelerating cavity according to claim 1 and modifying at least one operating parameter of the accelerating cavity depending on the quality factor of the accelerating cavity.

7. An operating method according to claim 6, wherein the at least one operating parameter is a power setpoint value for a radiofrequency wave emitted in the accelerating cavity, and wherein the modifying comprising decreasing the value of the power setpoint if the quality factor of the at least one accelerating cavity crosses a preset threshold, the other cavities of the particle accelerator, when they exist, being able to continue to operate.

8. A device for determining a quality factor of at least one accelerating cavity of a particle accelerator, the determining device comprising hardware and/or software elements that implement the method according to claim 1.

9. A particle accelerator comprising at least one determining device according to claim 8.

10. The particle accelerator according to claim 9, comprising at least one cryomodule having an accelerating cavity and a bath of a cryogenic fluid.

11. A computer program product, comprising program-code instructions stored on a computer-readable medium, for implementing the method according to claim 1.

12. A non-transitory computer-recording medium having embodied thereon a program, which when executed by a computer causes the computer to execute a method according to claim 1.

13. The method according to claim 4, wherein the estimation is carried out based on:

a volume of the cryogenic fluid in a liquid state, which is calculated based on a measurement of an amount of the cryogenic fluid entering and exiting the bath of cryogenic fluid; and a static heat load and a dynamic heat load received by the bath of cryogenic fluid; and an input specific enthalpy and an output specific enthalpy of the cryogenic bath, based on a measurement of a pressure of the bath of cryogenic fluid.

14. The method according to claim 4, wherein the estimation is carried out based on:

a volume of the cryogenic fluid in a liquid state, which is calculated based on a measurement of a height of the cryogenic fluid in the liquid state; and a static heat load and a dynamic heat load received by the bath of cryogenic fluid; and an output temperature of the bath of cryogenic fluid, based on a measurement of the pressure of the bath of cryogenic fluid and on an input mass concentration of the bath of cryogenic fluid.

15. The method according to claim 4, wherein the estimation is carried out based on:

a volume of the cryogenic fluid in a liquid state, which is calculated based on a measurement of an amount of the cryogenic fluid entering and exiting the bath of cryogenic fluid; and a static heat load and a dynamic heat load received by the bath of cryogenic fluid; and an output temperature of the bath of cryogenic fluid, based on a measurement of the pressure of the bath of cryogenic fluid and on an input mass concentration of the bath of cryogenic fluid.

16. The method according to claim 4, wherein the estimation is carried out based on:

a volume of the cryogenic fluid in a liquid state, which is calculated based on a measurement of a height of the cryogenic fluid in the liquid state and a measurement of an amount of the cryogenic fluid entering and exiting the bath of cryogenic fluid; and a static heat load and a dynamic heat load received by the bath of cryogenic fluid; and an input specific enthalpy and an output specific enthalpy of the cryogenic bath, based on a measurement of a pressure of the bath of cryogenic fluid.

17. The method according to claim 4, wherein the estimation is carried out based on:

a volume of the cryogenic fluid in a liquid state, which is calculated based on a measurement of a height of the cryogenic fluid in the liquid state and on a measurement of an amount of the cryogenic fluid entering and exiting the bath of cryogenic fluid; and a static heat load and a dynamic heat load received by the bath of cryogenic fluid; and an output temperature of the bath of cryogenic fluid, based on a measurement of the pressure of the bath of cryogenic fluid and on an input mass concentration of the bath of cryogenic fluid.

18. The particle accelerator according to claim 9, comprising at least one cryomodule having a plurality of accelerating cavities and a bath of a cryogenic fluid.

19. The method according to claim 3, wherein the particle accelerator is a linear particle accelerator.

* * * * *